US005181446A

United States Patent [19]

Theising

[11] Patent Number: 5,181,446

[45] Date of Patent: Jan. 26, 1993

[54] SELF-ALIGNING QUICK PICK-OFF RIP FENCE

[75] Inventor: John L. Theising, Florissant, Mo.

[73] Assignee: Emerson Electric Co., St. Louis, Mo.

[21] Appl. No.: 816,342

[22] Filed: Dec. 23, 1991

[51] Int. Cl.[5] ..... B26D 7/01; B27B 27/02

[52] U.S. Cl. ..... 83/438; 83/468; 83/468.7; 83/477.2

[58] Field of Search ..... 83/438, 444, 477.2, 83/468, 468.7; 269/303, 304, 315, 318

[56] References Cited

U.S. PATENT DOCUMENTS

| | | | |
|---|---|---|---|
| 2,325,082 | 7/1943 | Tautz | 83/438 |
| 2,808,084 | 10/1957 | Eschenburg et al. | 83/438 |
| 2,966,179 | 12/1960 | Gaskell | 83/438 |
| 3,011,531 | 12/1961 | Gaskell | 83/438 |
| 4,696,213 | 9/1987 | Conneally | 83/438 |
| 4,846,036 | 7/1989 | Metzger, Jr. et al. | 83/438 |

*Primary Examiner*—Frank T. Yost
*Assistant Examiner*—Eugenia A. Jones
*Attorney, Agent, or Firm*—Polster, Lieder, Woodruff & Lucchesi

[57] ABSTRACT

A self-aligning quick pick-off rip fence for use in a table saw is disclosed. The rip fence holds a workpiece relative to a rotatable saw blade extending through an upper surface of the table saw for longitudinal or rip cutting along the length of the workpiece. The rip fence includes a fence head slidably mounted to a front rail that is attached to the table saw. A fence channel is mounted to the fence head at a first end and extends across the upper surface of the table saw in generally parallel alignment with a plane extending through a rotatable saw blade and terminates in a second end. A self-aligning bearing is attached to the second end of the fence channel and is slidably mounted relative to a rear rail attached to the table saw. A handle assembly is mounted to the first end of the fence channel and is interconnected to the self-aligning bearing for engaging and disengaging same in locked and unlocked relationship to the rear rail. When locked to the rear rail, the self-aligning bearing causes the fence channel to be aligned in substantially squared position relative to the front rail, and when unlocked from the rear rail, enables the entire fence head and channel to be removed from the table saw. The self-aligning quick pick-off rip fence further includes both parallel and incremental adjustment structure for adjusting the fence in parallel relationship to the plane extending through the saw blade as well as precise incremental adjustment of the fence channel relative to the saw blade.

14 Claims, 4 Drawing Sheets

SELF-ALIGNING QUICK PICK-OFF RIP FENCE

BACKGROUND OF THE INVENTION

The present invention relates to a rip fence for a table saw, band saw or the like which permits longitudinal or rip cutting of a workpiece, and more particularly, to a self-aligning quick pick-off rip fence.

Table saws, with a rotating saw blade extending through an upper surface, are used for cross cutting (transverse cutting to the length of the workpiece), bevel cutting (at an angle to the length of the workpiece) and rip cutting (longitudinal cutting along the length of the workpiece). For cross cutting and bevel cutting, an angularly and laterally adjustable fixture or fence is used. On the other hand, for rip cutting, a separate rip fence must be used to hold the workpiece in the desired position for the longitudinal or rip cutting that is to be performed. Since the present invention is directed to a self-aligning quick pick-off rip fence for longitudinal or rip cutting, the discussion that follows will be limited solely to rip fences of this construction.

Prior art table saw rip fences have worked well in securing the rip fence relative to the table saw in order to hold a workpiece relative to the rotatable saw blade, while also permitting the rip fence to be properly and accurately adjusted relative to the rotatable saw blade for accurate longitudinal or rip cutting. Most of the problems that have arisen in connection with prior art rip fences of this type relate to the adjustment and simultaneous maintaining of the rip fence in a squared relationship relative to the rotatable saw blade. At the same time, the rip fence must be conveniently and quickly removed and subsequently reinstalled relative to the table saw.

SUMMARY OF THE INVENTION

Among the several objects and advantages of the present invention include:

The provision of a new and improved self-aligning quick pick-off rip fence for use with a table saw or the like;

The provision of the aforementioned rip fence which includes a fence channel extending across an upper surface of the table saw and a self-aligning bearing means at the rear end of the fence channel, the latter being locked or unlocked relative to the table saw, in order to securely retain the rip fence in substantially parallel relationship to the table saw blade when locked or permit quick release of the rip fence from the table saw when unlocked;

The provision of the aforementioned rip fence which includes a handle assembly operatively interconnected to the self-aligned bearing means for locking and unlocking same relative to the table saw;

The provision of the aforementioned rip fence which is capable of being adjusted in parallel relationship relative to a plane passing through the rotatable saw blade, for accurate and controlled parallel adjustment of the rip fence relative to the rotatable saw blade;

The provision of the aforementioned rip fence which includes incremental adjustment features for precise adjustment of the fence relative to a plane extending through the rotatable saw blade; and The provision of the aforementioned rip fence which is adaptable to existing table saws, is user-friendly, repeatably and continuously operates as desired, is simple and easy to operate, utilizes a minimum number of parts, is constructed for long lasting use, is made from durable materials, and is otherwise well adapted for the purposes intended.

Briefly stated, the self-aligning quick pick-off rip fence of the present invention is constructed for use with a table saw having an upper surface with a rotatable saw blade extending therethrough and front and rear surfaces extending transverse to the upper surface and generally parallel to each other. The rip fence includes elongated front and rear rails mounted to and extending along the front and rear surfaces of the table saw. A fence head is slidably mounted to the front rail. Attached to the fence head at a first end is a fence channel which extends across the upper surface of the table saw in generally parallel alignment with a plane extending through the rotatable saw blade and terminating in a second end. The fence channel supports a workpiece for rip cutting by the rotatable saw blade. At the second end of the fence channel is a self-aligning bearing means which is slidably mounted on the rear rail. Handle means are mounted to the first end of the fence channel and are interconnected to the self-aligning bearing means for engaging and disengaging same in lock and unlocked relationship relative to the rear rail. When the self-aligning bearing means is locked to the rear rail, the fence channel is aligned in substantially squared position relative to the front rail, and when unlocked from the rear rail, the entire fence head and fence channel can be removed from the table saw.

The handle means includes a fence lock rod connected between the handle means and the self-aligning bearing means. The self-aligning bearing means may include a spring loaded roller bearing which engages the elongated rear rail and is also operatively connected to the fence lock rod. The spring loaded roller bearing includes a spring element which is attached to the second end of the fence channel and supports the roller bearing at a lower end thereof. A flat spring is secured to a rear lock plate which is located adjacent the second end of the fence channel. The flat spring is secured to the rear lock plate at a point spaced upwardly from the roller bearing so as to operate as a hinge point for the spring loaded roller bearing. Preferably, the fence lock rod is secured to the rear lock plate intermediate the hinge point and the roller bearing.

As a further feature of the present invention, the self-aligning quick pick-off rip fence includes parallel adjustment means for adjusting the fence channel in parallel relationship to a plane extending through the saw blade. For this purpose, the fence channel is pivotally mounted to the fence head and the adjusting means operatively adjusts the fence channel relative to its pivotal mounting. In the preferred construction, the fence channel is mounted to first and second spaced posts extending upwardly from the fence head. The fence channel is pivotally mounted to one of the posts and the adjustment means operatively adjusts the fence channel relative to the other of said posts. The first post is typically a front post located closer to the saw blade with the second post being a rear post spaced farther from the saw blade than the front post. Both front and rear posts are longitudinally aligned with respect to one another along the fence channel. A one-piece bushing is attached along a bottom surface of the fence channel and includes spaced openings for receiving the spaced front and rear posts which extend upwardly from the fence head. Set screws are attached to the bushing for adjustably engaging the rear post to cause the fence channel to adjustably pivotally move about the front post for parallel alignment relative to the plane extending through the saw blade.

The self-aligning quick pick-off rip fence may further include incremental adjustment means for precise adjustment of the fence channel relative to the saw blade. In this connection, the incremental adjustment means is attached to the fence head and operatively engages an elongated bar attached to the front rail, on which the fence head is slidably mounted, for incremental adjustment thereof. The incremental adjustment means includes complementary gears provided on the fence head and the elongated bar as well as means for engaging the complementary gears to provide the incremental adjustment. The first gear is preferably attached to the fence head in normally out-of-engagement spring biased relationship relative to a second gear mounted on the elongated bar. The first gear is preferably a bevel gear while the second gear comprises an elongated spur gear.

In certain constructions, the interconnecting handle means including fence lock rod may be eliminated, with the use of a modified self-aligning bearing means and handle assembly to achieve the desired locked or unlocked relationship of the fence head and fence channel relative to the table saw, without the use of an interconnecting fence lock rod.

These and other objects and advantages of the present invention will become apparent from the description that follows.

BRIEF DESCRIPTION OF THE DRAWINGS

In the drawings.

Corresponding reference numerals will be used throughout the several figures of the drawings.

DESCRIPTION OF THE PREFERRED EMBODIMENT

The following detailed description illustrates the invention by way of example and not by way of limitation. This description will clearly enable one skilled in the art to make and use the invention, and describes several embodiments, adaptions, variations, alternatives and uses of the invention, including what I presently believe is the best mode of carrying out the invention.

The present invention relates to a self-aligning quick pick-off rip fence for use in a table saw, band saw or the like. The features of the present invention which will be discussed in detail below include a spring loaded bearing device that aligns the fence when locked to the table saw, a parallel adjustment mechanism for aligning the fence relative to a plane extending through a rotatable saw blade, and an incremental or micro-adjustment mechanism for precise adjustment of the fence relative to the rotatable saw blade, all of the above being accomplished while permitting the quick pick-off feature of the fence.

Figure 1:
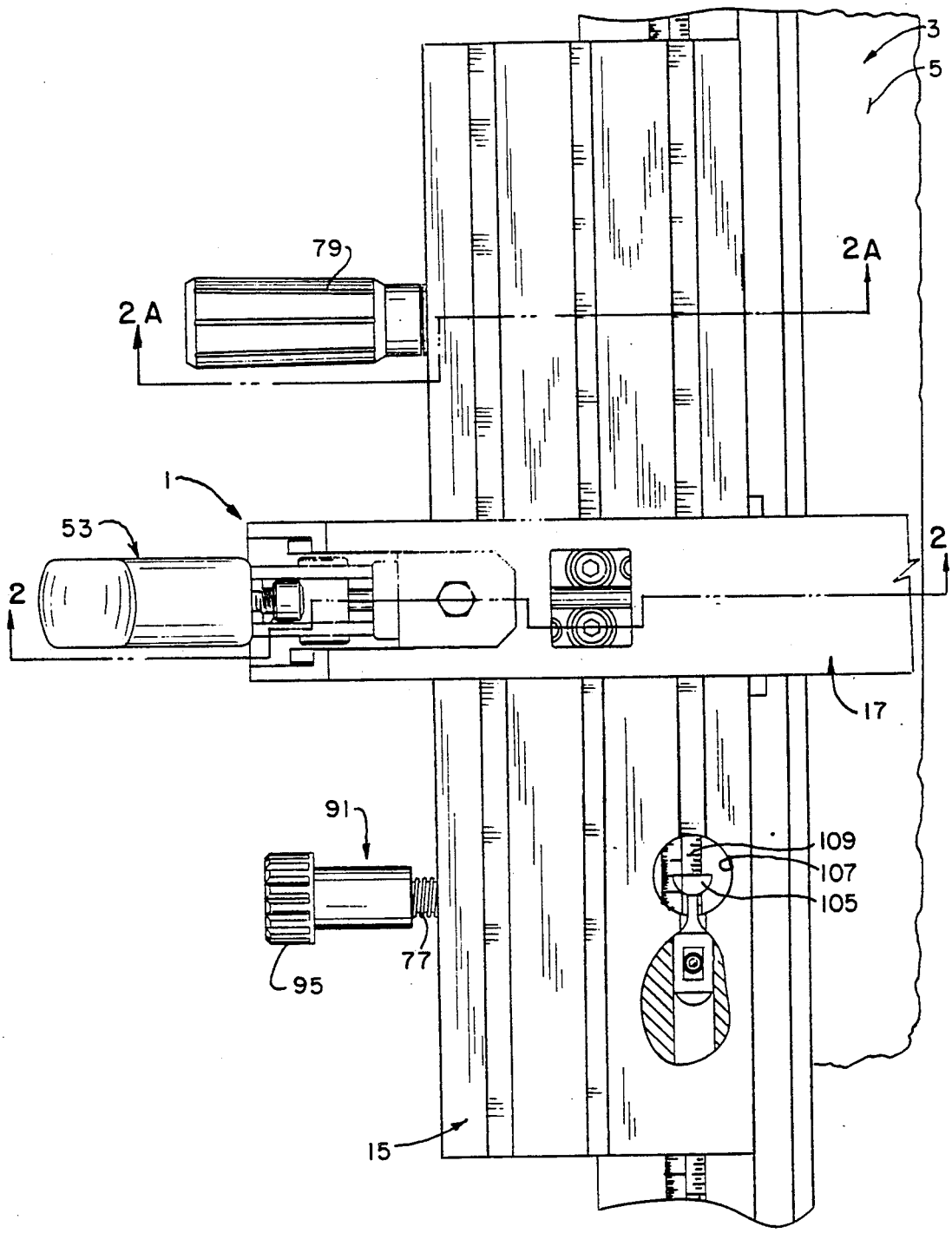
FIG. 1 is a fragmentary to plan view of the fence head and a part of the fence channel which form the rip fence constructed in accordance with the teachings of the present invention.
Figure 3:
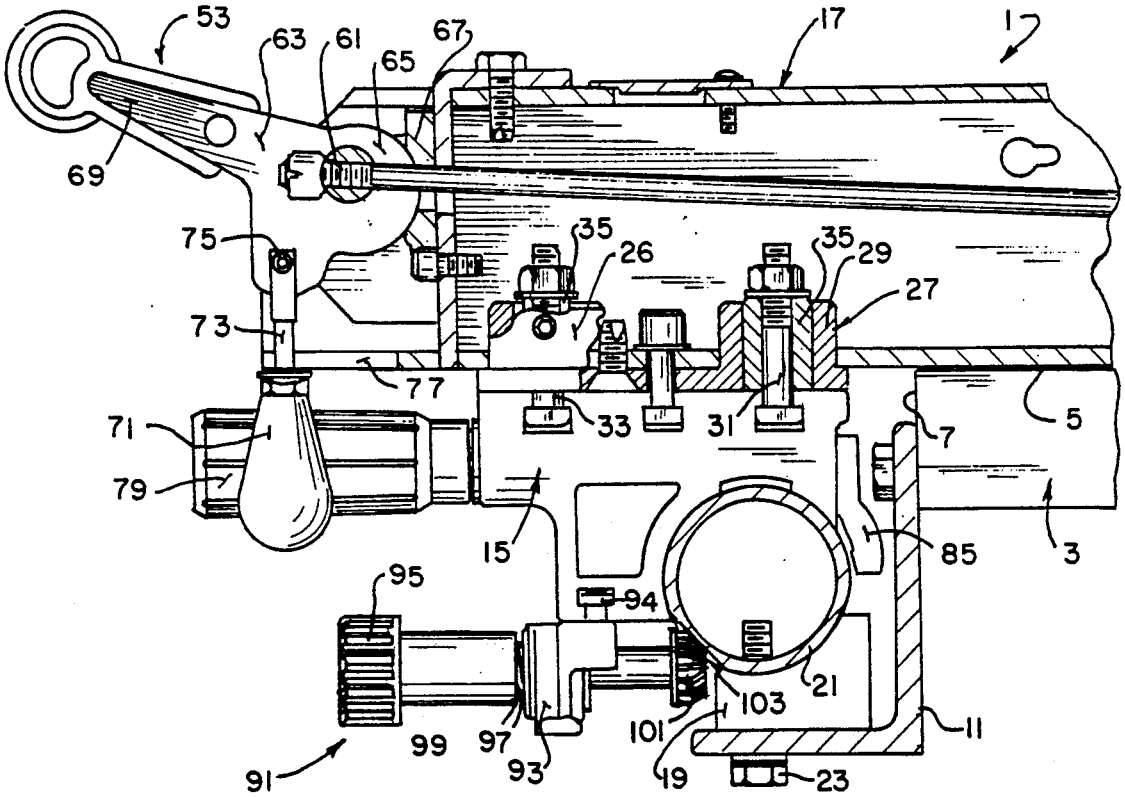
FIG. 3 is a fragmentary reduced in size view of the fence head and fence channel showing the incremental adjustment means positioned to incrementally adjust the fence head and fence channel of the rip fence, as viewed along line 2A—2A of FIG. 1.

As illustrated in FIG. 1 of the drawings, the rip fence 1 is constructed for use with a table saw 3 only partially shown in the drawings. The table saw 3 has an upper surface 5 on which the rip fence 1 is mounted for movement (FIG. 3). A rotatable saw blade (not shown) extends upwardly beyond the upper surface 5 of the saw table 3 to cut workpieces supported in position by the rip fence 1. An example of a rotatable saw blade which extends through an upper surface of the table saw and a rip fence moved relative to a plane extending through the body of the rotatable saw blade is shown in U.S. Pat. No. 4,846,036. The same arrangement and relationship of the rip fence 1 of the present invention relative to a rotatable saw blade, as shown in the aforementioned patent, is also contemplated in the present invention.

In addition to upper surface 5, the table saw 3 includes front and rear surfaces 7, 9, respectively, (FIGS. 3 and 6) which extend transverse to the upper surface 5 as well as extend generally parallel to each other. Attached to the front and rear surfaces 7, 9, respectively, are front and rear angle iron rails 11, 13, respectively, for use in conjunction with the rip fence 1. It will be noted that the front rail 11 is substantially larger than the rear rail 13, by comparing FIGS. 3 and 6 of the drawings. As illustrated, suitable bolts are used for attaching the front and rear rails 11, 13 respectively to the front and rear surfaces 7, 9, respectively, of the table saw 3.

Figures 2, 2A:
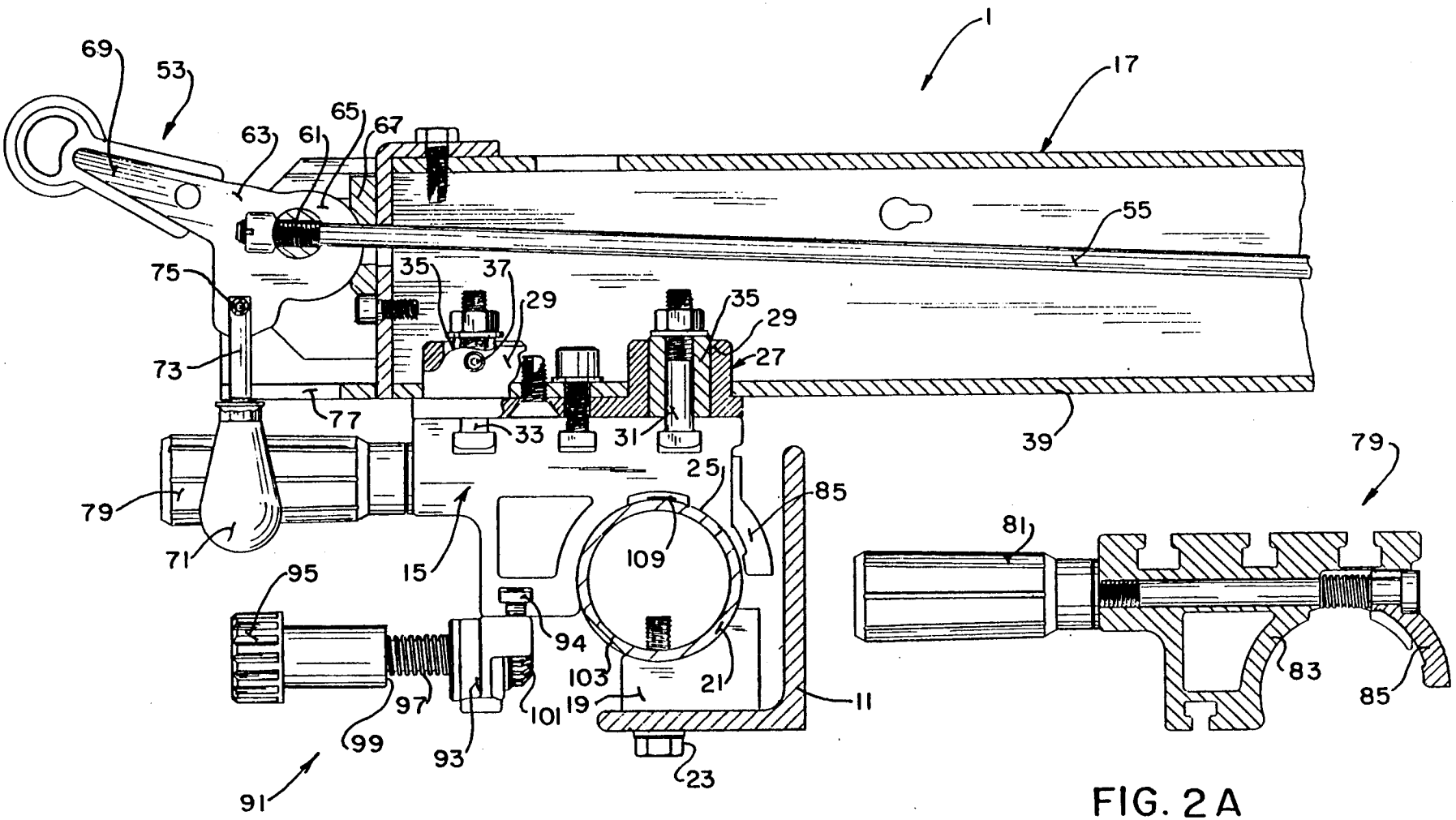
FIG. 2 is a fragmentary side elevational view, partly in section, of the fence head and fence channel construction which forms the rip fence of the present invention.
FIG. 2A is a side elevational view, partly in section, of a fence head locking means for securing the fence head and fence channel in a fixed position, as viewed along line 2A—2A of FIG. 1.

Rip fence 1 includes a fence head 15 which is slidably mounted relative to the front rail 11 and a fence channel 17 which extends across the upper surface 5 of the table saw 3 for supporting workpieces relative to a rotatable saw blade such as shown in U.S. Pat. No. 4,846,036. In order to permit movement of the fence head 15 and associated fence channel 17 relative to the fixed front rail 11, a front tube support 19 is supported by the horizontal arm of the L-shaped or angle iron front rail 11, and in turn, supports a front tube guide 21. The front tube guide 21 is supported from the bottom, through the use of a bolt 23 that extends through the horizontal arm of the front rail 11, the front tube support 19 and the front tube guide 21, as best shown in FIGS. 2–3 of the drawings.

The fence head 15 is preferably an extruded aluminum body having a semi-cylindrical or curvilinear section 25 which is complementary in shape to the front tube guide 21, in order that the fence head 15 can slide back and forth along the front tube guide 21. This movement of the fence head 15 serves to position the interconnected fence channel 17 relative to the rotatable saw blade.

The fence head 15 is interconnected to the fence channel 17 through a one-piece bushing 27 that is fastened to the bottom of the fence channel 17. The one-piece bushing 27 includes spaced tubular collars 29, 29 which extend upwardly within the fence channel 17 and receives spaced front and rear posts 31, 33 which are attached to the fence head 15. Spacers 35, 35 are located between the collars 27, 27 and the front and rear posts 31, 33. The front and rear posts 31, 33 are shown in FIGS. 2 and 3 of the drawings as bolt and nut fasteners where the bolt head is received within a complementary T-shaped opening in the fence head 15 while the opposite threaded end of the bolts receive a corresponding threaded nut. The aforementioned construction interconnects the fence head 15 to the fence channel 17.

The one-piece bushing 27 and interconnected post construction as described is also useful in adjusting the fence channel 17 in parallel alignment with a plane passing through the body of the rotatable saw blade (not shown). In this regard, the fence channel 17 is constructed to pivot about the front post 31 so that a user can align the fence channel 17 in parallel alignment to the plane of the rotatable saw blade (not shown). The rear post 33 is smaller in diameter than the front post 31 such that the fence channel 17 can pivot about the front post 31. Two set screws 37, 37 are located in the rear portion of the bushing 27, in the area of the rear collar 29 for engagement with the rear post 33. Thus, the set screws 37, 37, when adjusted, push against the rear post 33, causing the fence channel 17 to pivot about the front post 31 which, in turn, aligns the fence channel in parallel arrangement to the plane of the rotatable saw blade (not shown). For this purpose, the opposite sides of the fence channel 17 are provided with access holes (not shown) in order that a user may readily adjust the set screws 37, 37 as desired.

The bushing/post construction described above allows the fence channel 17 to be easily adjusted as described above, without in any way interfering with the pick-off features of the rip fence, as will be further described below.

Figure 4:
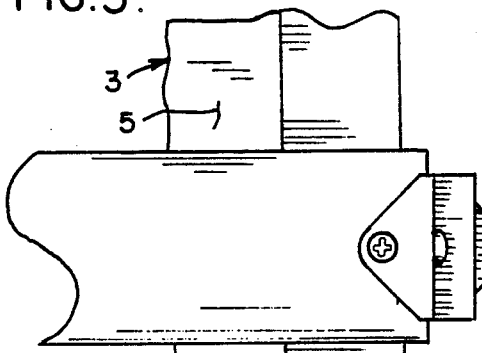
FIG. 4 is a fragmentary top plan view of the fence channel and the self-aligning bearing means at the rear end of the fence channel.
Figure 6:
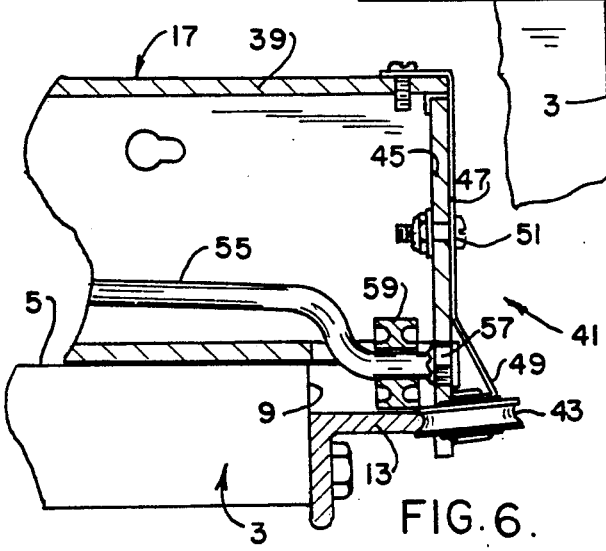
FIG. 6 is a fragmentary elevational view, partly in section, of the self-aligning bearing means and associated fence lock rod which moves the self-aligning bearing means in locked and unlocked position relative to a rear rail at the rear of the table saw.
Figure 5:
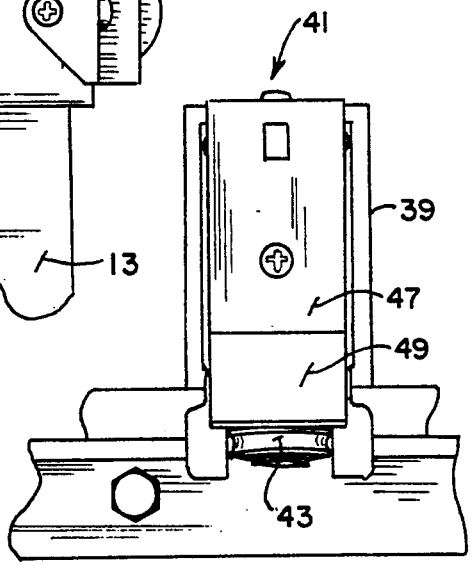
FIG. 5 is a fragmentary rear end view of the table saw which shows the self-aligning bearing means mounted relative to a rear rail at the rear of the table saw.

The fence channel 17 is an elongated hollow element 39 that extends across the upper surface 5 of the table saw 3. At its front end, it is interconnected to and supported by the fence head 15, as just described. At the rear end of the fence channel 17, as best shown in FIGS. 4–6 of the drawings, the self-aligning bearing mechanism 41 is provided. The self-aligning bearing mechanism 41 includes a spring loaded roller bearing 43 which engages the rear rail 13, as seen in FIGS. 5–6 of the drawings, to enable the fence channel 17 to slidably move along the rear rail 13 at the rear of the table saw 3, while being slidably mounted on the front tube guide 21 to the interconnected fence head 15.

As best seen in FIG. 6 of the drawings, the hollow elongated element 39 forming the fence channel 17 has a rear lock plate 45 to which a flat spring 47 is attached by suitable fasteners, as shown. The flat spring 47 has an outwardly extending portion 49 at its lower end to which the roller bearing 43 is attached, as illustrated. It is to be noted that the flat spring 47 is secured to the rear lock plate 45 at a point spaced upwardly from the roller bearing 43, as at 51, to operate as a hinge point for the spring loaded roller bearing 43.

The self-aligned bearing mechanism 41, when locked to the rear rail 13, causes the fence channel 17 to be aligned in substantially squared position relative to the front and rear rails 11, 13, respectively. When unlocked from the rear rail 13, the self-aligning bearing mechanism 41 enables the entire fence head 15 and fence channel 17 to be removed from the table saw 3.

In order to lock and unlock the self-aligned mechanism 41 relative to the rear rail 13, the handle assembly 53 is mounted to the first or front end of the fence channel 17 and is interconnected to the self-aligned bearing mechanism 41 through the fence lock rod 55 for engaging and disengaging the self-aligned bearing mechanism in locked and unlocked relationship relative to the rear rail 13. In this connection, note that the fence lock rod 55 is connected to the rear lock plate 45 intermediate the hinge point 51 and the roller bearing 43 and is supported by a roller 59 which rides on an upper surface of the rear rail 13, when the spring loaded roller bearing 43 slides along the rear rail 13.

At the first or front end of the fence channel 17, the fence lock rod 55 is threadably interconnected at 61 to a rotatable handle body 63. In this connection, note that the rotatable handle body 63 includes a spherical portion 65 that rotates in a complementary shaped curved element 67 that is mounted to the first or front end of the fence channel 17. An integral handle 69 extends in an opposite direction to the spherical portion 65 for engagement by the user. When the handle 69 is depressed, the fence lock rod 55 draws or pulls the spring loaded bearing 43 into engagement with the rear rail 13, in order to lock the self-aligned bearing mechanism 41 in position. When the handle 69 is raised, the self-aligned bearing mechanism 41 is unlocked from the rear rail 13, enabling the entire fence head 15 and fence channel 17 to be removed from the table saw.

In order to be able to slide the fence head 15 with the self-aligning bearing mechanism 41 in an engaged or locked position relative to the rear rail 41, a handle knob 71 is attached to the end of a threaded rod 73 which is pivotally mounted at 75 to the handle body 63 and extends downwardly therefrom as best seen in FIGS. 2–3 of the drawings. The handle knob 71 and threaded rod 73 are pivotable into and out of an open ended slot 77 formed at a lower end of the fence channel 17. When located within the open end of slot 77, the handle knob 71 can then be threaded upwardly relative to the threaded rod 73 so as to push against the bottom of the fence channel 17. Thus, in turn, causes the handle assembly 53 to be moved down and held in position. As a result, the self-aligned bearing mechanism 41 is locked or engaged with respect to the rear rail 13. By turning the handle knob 71, the user can adjust the tension on the self-aligned bearing mechanism 41.

Once the fence channel 17 is in the desired location, the user can lock the fence channel 17 by pushing the handle 69 all the way down which causes the fence lock rod 55 to engage the rear lock plate 47 and move the spring loaded bearing 43 into engaged or locked position relative to the rear rail 13. As a result, the fence channel 17 will be moved in substantially squared position relative to the front and rear rails 11, 13 respectively. It is to be noted that the handle assembly 53, including the fence lock rod 55 is mounted to the fence channel 17 or contained within the fence channel 17. This enables the fence channel 17 and the handle assembly 53 to be removed from the fence head 15 as a unit, with minimal disassembly, for easier shipment/servicing.

To assure adequate locking of the fence head 15 to the tube guide 21, a second locking mechanism 79 is provided. This second locking mechanism 79 includes interconnected handle section 81 and cooperating clamps 83, 85 which have an interior surface corresponding to the exterior shape of the front tube rail 21. As the handle section 81 is turned, the clamps 83, 85 are brought into engaged or disengaged position relative to the front tube rail 21. Because of the ease of operation, this second locking mechanism 79 also allows for the quick pick-off feature of the rip fence 1. The preferred location of the second locking means 79 is illustrated in FIG. 1 immediately to the left of the rip fence I, for operation as described above.

In addition to the self-aligned bearing mechanism and the parallel adjustment mechanism discussed above, the present invention further provides an incremental adjustment mechanism which allows fine or precise adjustment of the rip fence 1 relative to the plane of the rotatable saw blade (not shown). For this purpose, an incremental or "micro adjust" mechanism 91 is attached to the lower end of the fence head, as best shown in FIGS. 2-3 of the drawings.

The incremental or "micro adjust" mechanism 91 includes a front bar guide 93 which is attached to the lower end of the fence head 15 by way of the bolt 94 received in a corresponding T-shaped slot or recess formed in the lower end of the fence head 15. An incremental or "micro adjust" knob 95 is normally spring biased away from the front tube guide 21 by the spring 97 that is trapped between the front bar guide 93 and the enlarged shoulder 99 formed at one end of the incremental or "micro adjust" knob 95.

At the free end of the adjusting knob 95, on the opposite side of the front bar guide 93, a bevel gear 101 is provided. The bevel gear 101 is constructed for complementary mating engagement with the spur gear section 103 cut into the front tube guide 21, when the incremental or "micro adjust" knob 95 is pushed inwardly to compress the spring 97. This is best shown in FIG. 3 of the drawings where the incremental or "micro adjust" knob 95 is pushed inwardly against the spring 97 to move the bevel gear 101 into engagement with the spur gear 103, in order to provide precise or micro adjustment of the fence head 15 and fence channel 17 relative to the plane of the rotatable saw blade (not shown).

Preferably, bevel gear 101 is a "Beveloid ®" gear that is particularly useful in the incremental "micro adjust" mechanism 91 of the present invention. A "Beveloid ®" gear is a completely generalized form of involute gear that has a tapered tooth thickness, root and outside diameter. Such gears are useful primarily for precision-instrument drives where the combination of high precision and limited load-carrying ability fits the application.

As best seen in FIG. 1, the incremental or "micro adjust" mechanism 91 can be visually adjusted by the indicator 105 that is attached to the fence head 15 and extends within a hole 107 through the fence head 15. The scale 109, attached to the upper end of the front tube guide 21 (see FIG. 2) can be visually aligned with the indicator 105 for precise adjustment of the incremental or "micro adjust" mechanism 91.

The aforementioned complementary gear engagement of the incremental or "micro adjust" mechanism 91 affords precise unlimited engagement travel of the fence head 15, and therefore, the fence channel 17, relative to the plane of the rotatable saw blade (not shown). In addition, by being able to locate or cut a gear rack or section 103 at 45° from the bottom of the fence head 15, this enables the front guide tube 21 to be mounted from the bottom side, through the bolt 23, also permitting easier alignment of the front and rear rails 11, 13 respectively.

Figures 7, 8:
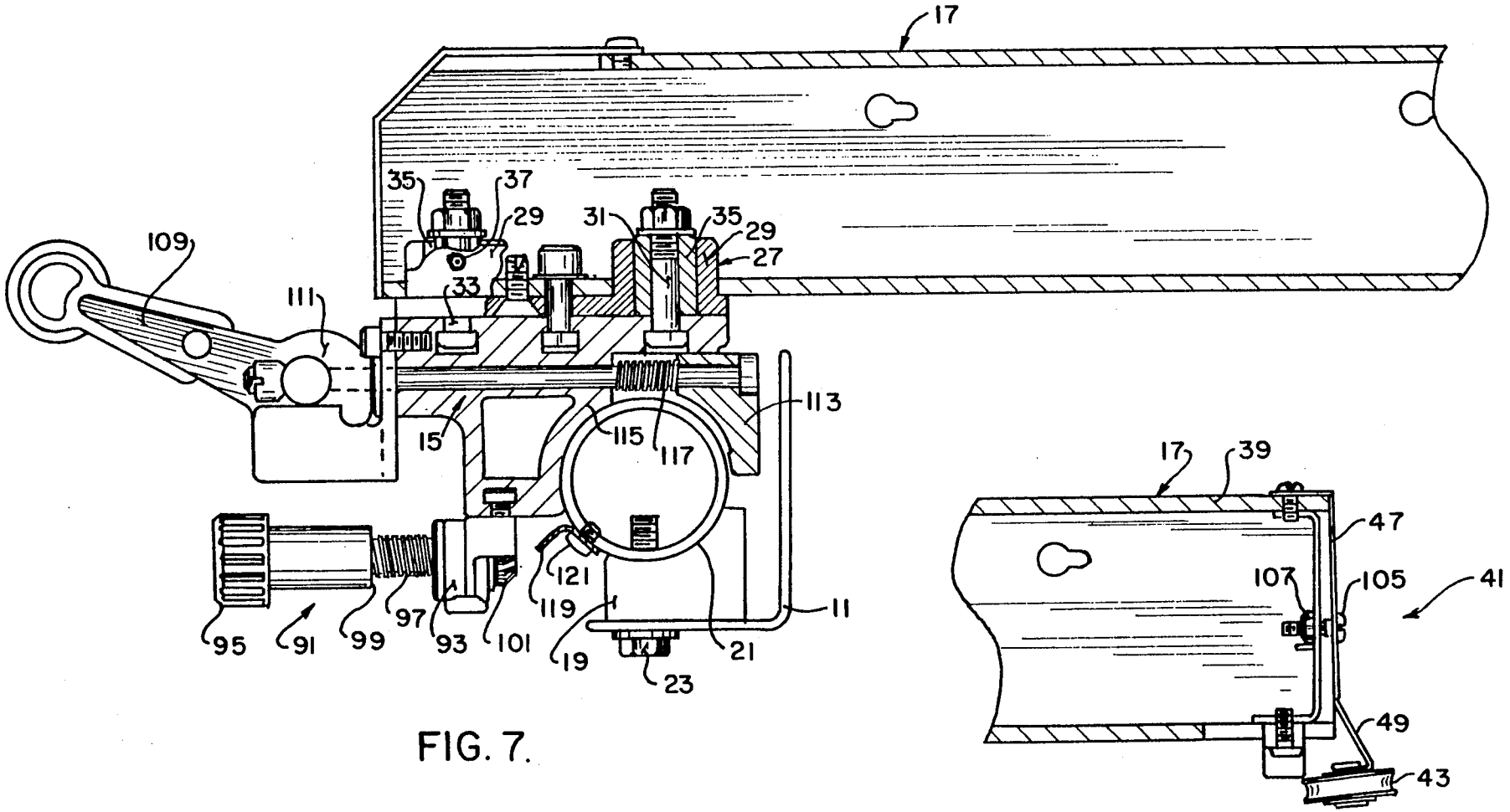
FIG. 7 is a modified form of self-aligned quick pick-off rip fence and fence channel providing a modified rip fence of the present invention.
FIG. 8 is a fragmentary elevational view, partly in section, of a modified form of self-aligning bearing means used with the modified rip fence shown in FIG. 7 of the drawings.

Instead of having a spur gear cut into the tube guide 21 as at 103, it is possible to attach a separate spur gear element, such as a sheet metal spur rack, bent at 90°, as shown for example in FIG. 7 of the drawings.

Reference is now made to the modified form of the rip fence shown in FIGS. 7-8 of the drawings which uses the same reference numerals to designate like parts as shown in the FIGS. 1-6 embodiment. This modified design is a fence head 15 that is locked to the front tube guide 21 only. There is no handle assembly. Instead, the bearing mechanism 41, including the spring loaded roller bearing 43 is "hooked" on the rear rail 13. Bearing tension is accomplished by a screw 105 that is threaded to a plate 107 mounted to the rear end of the fence channel 17.

In order to lock the fence head 15 and associated fence channel 17 to the front tube guide 21 only, a cam actuated handle 109 is utilized. The cam actuated handle 109 has a cam 111 which engages the front end of the fence head 15, when moved in a downward direction, in order to move the clamp 113 into cooperative clamping engagement with the clamp 115 of the fence head 15, as shown in FIG. 7. The moveable clamp 113 is normally spring biased outwardly by the spring 117, but upon depression of the cam actuated handle 109, the clamp 113 is drawn into clamping engagement with the clamp 115, for locking the fence head relative to the front tube guide 21. An alternative locking mechanism in lieu of the cam actuated handle 109 and clamps 113, 115 would be a screw actuated mechanism 79 that is shown in FIG. 2A of the drawings. In either case, the fence head 15 would be locked solely to the front tube guide 21, and the bearing mechanism 41 would independently operate such locking or clamping mechanism, without the need for a handle assembly as shown in the FIGS. 1-6 embodiment. Note further that the FIG. 7 embodiment shows a separate rack gear 119 mounted by the screw 121 to the front tube guide 21, at 45° at the bottom of the fence head 15. The separate rack gear 119 is bent at 90° relative to the front tube guide 21, for engagement with the bevel gear 101, in the same manner described above.

From the foregoing, it will now be appreciated at the self-aligning quick pick-off rip fence of the present invention includes a spring loaded bearing device that aligns the fence when locked to the table saw, a parallel adjusting mechanism for parallel aligning the fence relative to a plane extending through a rotatable saw blade, and an incremental or micro adjustment for precise adjustment of the fence relative to the rotatable saw blade. All of the above features are provided, while at the same time affording the quick pick-off feature of the fence.

In view of the above, it will be seen that the several objects and features of this invention are achieved and other advantageous results obtained.

As various changes could be made in the above constructions without departing from the scope of the invention, it is intended that all matter contained in the above description or shown in the accompanying drawings shall be interpreted as illustrative and not in a limiting sense.

I claim:

1. A self-aligning quick pick-off rip fence for use in a table saw having an upper surface with a rotatable saw blade extending therethrough and front and rear surfaces extending transverse to said upper surface and generally parallel to each other, said rip fence comprising:

elongated front and rear rails mounted to and extending along the front and rear surfaces of said table saw;

a fence head slidably mounted to said front rail;

a fence channel mounted to said fence head at a first end and extending across the upper surface of the table saw in generally parallel alignment with a plane extending through said rotatable saw blade and terminating in a second end, said fence channel supporting a workpiece for rip cutting by said rotatable saw blade;

a self-aligning roller bearing attached to the second end of said fence channel and being slidably mounted on said rear rail; and a handle mounted to the first end of said fence channel and being connected by a fence lock rod extending between said handle and said self-aligning roller bearing for engaging and disengaging said self-aligning roller bearing in locked and unlocked relationship to said rear rail;

said fence lock rod connected to a rear lock plate located adjacent the second end of said fence channel;

a flat spring secured to said rear lock plate at a hinge point spaced upwardly from and being connected to said self-aligned roller bearing so as to spring load said self-aligned roller bearing against said rear rail;

said fence lock rod being secured to said rear lock plate intermediate said hinge point and said self-aligned roller bearing and including an independent roller element for supporting said fence lock rod in a generally horizontally position through rolling engagement with a surface immediately adjacent said rear rail;

said self-aligning roller bearing when locked and spring loaded to said rear rail causing the fence channel to be aligned in substantially squared position relative to said front and rear rails and when unlocked from said rear rail enabling the entire fence head and fence channel to be removed from said table saw.

2. The self-aligning quick pick-off rip fence as defined in claim 1 and further including parallel adjustment means for adjusting the fence channel in parallel relationship to the plane extending through said saw blade.

3. The self-aligning quick pick-off rip fence as defined in claim 1 and further including incremental adjustment means for precise adjustment of the fence channel relative to the plane extending through said saw blade.

4. A self-aligning quick pick-off rip fence for use in a table saw having an upper surface with a rotatable saw blade extending therethrough and front and rear surfaces extending transverse to said upper surface and generally parallel to each other, said rip fence comprising:

elongated front and rear rails mounted to and extending along the front and rear surfaces of said table saw;

a fence head slidably mounted to said front rail;

a fence channel mounted to said fence head at a first end and extending across the upper surface of the table saw in generally parallel alignment with a plane extending through said rotatable saw blade and terminating in a second end, said fence channel supporting a workpiece for rip cutting by said rotatable saw blade;

self-aligning bearing means attached to the second end of said fence channel and being slidably mounted on said rear rail;

handle means mounted to the first end of said fence channel and being interconnected to said self-aligning bearing means for engaging and disengaging said self-aligning bearing means in locked and unlocked relationship to said rear rail;

said self-aligning bearing means when locked to said rear rail causing the fence channel to be aligned in substantially squared position relative to said front and rear rails and when unlocked from said rear rail enabling the entire fence head and fence channel to be removed from said table saw; and parallel adjusting means for adjusting the fence channel in parallel relationship to the plane extending through said saw blade, said parallel adjusting means including front and rear posts extending upwardly from said fence head upon which said fence channel is mounted, said rear post being located closer to said handle means than said front post, said front and rear posts being generally aligned with respect to one another along said fence channel, a one-piece bushing attached to a bottom surface of said fence channel and including spaced openings for receiving the spaced front and rear posts, and set screws attached to said bushing for adjustably engaging the rear post to cause the fence channel to adjustably pivotally move about said front post for parallel alignment relative to the plane extending through the saw blade.

5. A self-aligning quick pick-off rip fence for use in a table saw having an upper surface with a rotatable saw blade extending therethrough and front and rear surfaces extending transverse to said upper surface and generally parallel to each other, said rip fence comprising:

elongated front and rear rails mounted to and extending along the front and rear surfaces of said table saw;

an elongated cylindrical guide bar mounted to the front rail along the front surface of the table saw;

a fence head slidably mounted to said elongated cylindrical guide bar, said fence head including an adjustable curvilinear bearing surface for engaging the elongated cylindrical guide bar in clamped relationship;

a fence channel mounted to said fence head at a first end and extending across the upper surface of the table saw in generally parallel alignment with a plane extending through said rotatable saw blade and terminating in a second end, said fence channel supporting a workpiece for rip cutting by said rotatable saw blade;

self-aligning bearing means attached to the second end of said fence channel and being slidably mounted on said rear rail, said self-aligning bearing means being in generally opposed relationship to the adjustable curvilinear bearing surface associated with said fence head;

said self-aligning bearing means when mounted to said rear rail cooperating with the adjustable curvilinear bearing surface of said fence head when engaging said elongated cylindrical guide bar to cause the fence channel to be aligned in substantially squared position relative to said front and rear rails; and said fence head including said adjustable curvilinear bearing surface engaging said elongated cylindrical guide bar substantially along upper surface areas thereof to facilitate the quick pick-off of the rip fence from the table saw when said fence head is disengaged from said elongated cylindrical guide bar.

6. The self-aligning quick pick-off rip fence as defined in claim 5 including handle means mounted to the first end of said fence channel and being interconnected to said self-aligning bearing means for engaging and disengaging the rear rail in locked and unlocked relationship.

7. The self-aligning quick pick-off rip fence as defined in claim 5 including incremental adjustment means comprising complementary gear means provided on both said fence head and lower surface areas of said elongated cylindrical guide bar, and means for engaging said complementary gears to provide said incremental adjustment.

8. The self-aligning quick pick-off fence as defined in claim 7 wherein a first gear attached to said fence head is normally spring biased out of engagement with a second gear mounted on the lower surface areas of said elongated cylindrical guide bar.

9. The self-aligning quick pick-off fence as defined in claim 8 wherein said first gear mounted on said fence head comprises a bevel gear and said second gear mounted on lower surface areas of said elongated cylindrical guide bar comprises an elongated spur gear means.

10. A self-aligning quick pick-off rip fence for use in a table saw having an upper surface with a rotatable saw blade extending therethrough and front and rear surfaces extending transverse to said upper surface and generally parallel to each other, said rip fence comprising:

elongated front and rear rails mounted to and extending along the front and rear surfaces of said table saw;

a fence head slidably mounted to said front rail along an elongated cylindrical guide bar supported by said front rail;

a fence channel mounted to said fence head at a first end and extending across the upper surface of the table saw in generally parallel alignment with a plane extending through said rotatable saw blade and terminating in a second end, said fence channel supporting a workpiece for rip cutting by said rotatable saw blade;

first bearing means attached to the first end of the fence head including an adjustable curvilinear surface extending from said fence head and engaging substantially upper areas of said elongated cylindrical guide bar;

second bearing means attached to the second end of said fence channel and engaging said rear rail in generally opposed relationship to limited surface areas of said adjustable curvilinear surface;

handle means attached to said fence head for clamping and unclamping said fence channel through said adjustable curvilinear bearing surface to said elongated cylindrical guide bar; and said fence head enabling quick pick off from said table saw when said handle means unclamps said fence head from said elongated cylindrical guide bar.

11. The self-aligning quick pick-off rip fence as defined in claim 10 wherein said adjustable curvilinear surface engages upper areas of said elongated cylindrical guide bar throughout a circumferential extent of approximately 180°.

12. The self-aligning quick pick-off fence as defined in claim 10 and further including parallel adjustment means for adjusting the fence channel in parallel relationship to a plane extending through said saw blade and incremental adjustment means for precise adjustment of the fence channel relative to a plane extending through said saw blade.

13. The self-aligning quick pick-off fence as defined in claim 12 wherein said parallel adjustment means includes spaced front and rear posts generally aligned with each other along said fence channel, said rear post being located closer to said handle means than said front post, and means for adjustably engaging the rear post to cause the fence channel to adjustably pivotally move about the front post for parallel alignment relative to a plane extending through the saw blade.

14. The self-aligning quick pick-off fence as defined in claim 12 wherein said incremental adjustment means includes complementary gear means provided on both said fence head and lower surface areas of said elongated cylindrical guide bar, and means for engaging the complementary gears to provide said incremental adjustment.

* * * * *